US005547226A

United States Patent [19]

Wentworth

[11] Patent Number: 5,547,226

[45] Date of Patent: Aug. 20, 1996

[54] HOUSEHOLD FILING SYSTEM

[76] Inventor: Claudia H. Wentworth, 108 Crest Ave., Walnut Creek, Calif. 94595

[21] Appl. No.: 494,730

[22] Filed: Jun. 26, 1995

[51] Int. Cl.[6] ..... B42F 21/00

[52] U.S. Cl. ..... 283/36; 283/37; 283/67

[58] Field of Search ..... 283/36, 37, 38, 283/41, 42, 67, 117; 40/359; 493/947

[56] References Cited

U.S. PATENT DOCUMENTS

| | | | |
|---|---|---|---|
| 960,693 | 6/1910 | Perrine . | |
| 2,142,460 | 1/1939 | Schulz | 283/43 |
| 4,445,711 | 5/1984 | Cunningham . | |
| 4,572,547 | 2/1986 | Phillips | 283/36 |
| 4,715,621 | 12/1987 | Colavita et al. . | |
| 4,795,196 | 1/1989 | Hyun et al. | 283/36 X |
| 4,832,374 | 5/1989 | Prest, Jr. . | |
| 4,932,683 | 6/1990 | Perazza | 283/36 X |
| 4,973,086 | 11/1990 | Donnelley et al. . | |
| 5,123,676 | 6/1992 | Donnelley et al. . | |
| 5,417,457 | 5/1995 | Reinhardt | 283/36 X |

*Primary Examiner*—Willmon Fridie, Jr.
*Attorney, Agent, or Firm*—Harris Zimmerman

[57] ABSTRACT

A filing system for storing, organizing, and handling household documents and data includes a file container in which a series of file folders are supported. Each file folder is provided with a label for a general topic and a related color for ease of identification. In general, red file folders are used for the distribution of information, mail processing, bills to be paid, and paperwork to be filed. Green file folders are used for the documentation of money received and expensed paid out. Orange file folders store information related to auto expenses and insurance, mortgage and loans, and taxes and personal finances. Blue file folders are designated for storage of information relating to legal, medical and dental, and general family matters. Information regarding general household and community matters is stored in yellow file folders. Within each file folder are a plurality of file folders, each labeled with subheadings for topics that are specific subjects relating to the general topic of the larger file folder and provided with the same color as the file folder in which it resides. In addition, selected file folders are provided with one or more icons in addition to topic labels. Each icon represents a cross-reference to another file folder. One icon indicates that further information is contained in another file folder. Another icon indicates that information within the file folder is relevant to filing tax returns. In addition, an icon may indicate that the file folder contains copies of documents which are stored elsewhere; e.g., safe, fireproof box, or sale deposit box. A further icon may indicate that the file folder contains information forms to be completed by the user, so that necessary information is elicited, organized, and stored for easy retrieval.

24 Claims, 8 Drawing Sheets

✌ = Further info in related folder

▯ = info for tax returns

★ = original documents in safe storage

❑ = forms to be filled in with information relating to file folder subheading

HOUSEHOLD FILING SYSTEM

BACKGROUND OF THE INVENTION

The present invention generally relates to a system for storage and retrieval of documents relating to personal and household information, and more particularly to a filing system that facilitates successful organization and operation of household finances as well as organization and storage of relevant data and documents.

The operation of a personal or family household is a job that is similar in many aspects to the operation of a business enterprise. As in the commercial realm, household functions have become increasingly complex in recent years. Whereas the most complex home-related financial task for most persons formerly comprised balancing a checkbook, many individuals are now faced with managing investment portfolios for personal retirement funds, monitoring funds held in savings accounts, checking accounts, money market funds, mutual funds, and the like. Furthermore, scheduled debt payments now include adjustable rate mortgages, credit cards, loan payments, and the like which may vary over time. In addition, medical information and medical insurance payments, insurance claims, co-payments, deductibles and other cumulative payments and debts require rigorous record keeping. Clearly the days of simple budgeting and cash management are long gone.

Unfortunately, most individuals have no training in these matters, either in business operation or household management. Many people are bewildered by the information to be taken in and organized, issues to be weighed, payments to be made, and the planning required to operate within a complex budget. As a result, errors in bank and financial statements go unchecked and unremediated, debt payments accumulate late charge penalties, interest rate return is not maximized, medical insurance reimbursements are not sought or fully paid, and the like. These problems are exacerbated by the fact that in most households, either both individuals work full time, or the household is headed by a single, working adult. In either case the time and energy available to be devoted to household management is limited. Although households are maintained and life goes on, there is a great discrepancy between the ideal of optimal household operating level and the average household operation. This discrepancy represents not only a financial loss for a household, but also a measure of anxiety and distress for the person responsible for operation of the household.

SUMMARY OF THE INVENTION

The present invention generally comprises a filing system for storing, organizing, retrieving and handling household documents and data, whereby a system of household operation may be established to regularize the tasks associated with personal and household financial matters and information storage.

The apparatus of the invention includes a file container in which a series of hanging file folders are supported. The file container includes opposed upper edges provided with a smooth plastic or metal track to facilitate ease of file movement. Each hanging file folder is provided with a label for a general topic and a related color for ease of identification. Among the plurality of hanging file folders, some may be provided the stone color if they are related in subject matter. For example, hanging file folders labeled "Mail" and "Monthly To Be Filed" are both the same color, preferably red.

In general, red file folders are used for the systematized distribution of information, mail processing, bills to be paid, and paperwork to be filed. Green file folders are used for the documentation of money received and expensed paid out. These papers store the data which may be used to construct a household budget, and keep records for filing tax returns. In addition, warranties and receipts for product purchases are maintained in green file folders. Orange file folders store information related to auto expenses and insurance, mortgage and loans, and taxes and personal finances. Blue file folders are designated for storage of information relating to legal, medical and dental, and general family matters. Information regarding general household and community matters is stored in yellow file folders.

Within each hanging file folder are a plurality of file folders, each also labeled and provided with the same color as the file folder in which it resides. The file folders are also labeled with subheadings for topics that are specific subjects relating to the general topic of the larger file folder. For example, within the red "Monthly To Be Filed" there are twelve file folders, all red and each labeled with a month of the year. Likewise, in the orange, blue, and yellow information file folders, each file folder includes a plurality of file folders of the same respective color and labeled with subtopics that related to the general topic of the file folder. Thus well-defined locations are provided for virtually all information and all matters that pertain to household operation, personal finances, and personal data storage.

In addition, file folders are cross-referenced using an icon-based system. Selected file folders are provided with one or more icons in addition to topic labels. Each icon represents a cross-reference to another file folder. For example, one icon indicates that further information is contained in another file folder. Another icon indicates that information within the file folder is relevant to filing tax returns. In addition, an icon may indicate that the file folder contains copies of documents which are stored elsewhere; e.g., safe, fireproof box, or safe deposit box. A further icon may indicate that the file folder contains forms included in the system to elicit and organize information that is appropriate for the file folder subheading.

The filing system is arranged so that initial entry of information is through the red folders, in which incoming mail, bills, and other documents are initially deposited. One red incoming file folder is surveyed frequently for bills to be paid, tasks to be accomplished, and the like. As items are taken from the red folder and processed, they are then placed in the topic folders to which they relate. The information folders contain long-term documents, such as insurance policies, personal medical and financial information, prior tax returns, birth certificates, and the like, as well as non-critical information such as favorite recipes, birthday lists, serial numbers of appliances, credit card numbers, and the like.

DESCRIPTION OF THE PREFERRED EMBODIMENT

The present invention generally comprises a filing system for storing, organizing, and handling both long-term and short-term personal and household documents and data to establish a scheme of household operation that systematizes the tasks associated with personal and household financial matters, and information storage and retrieval.

Figures 1, 3:
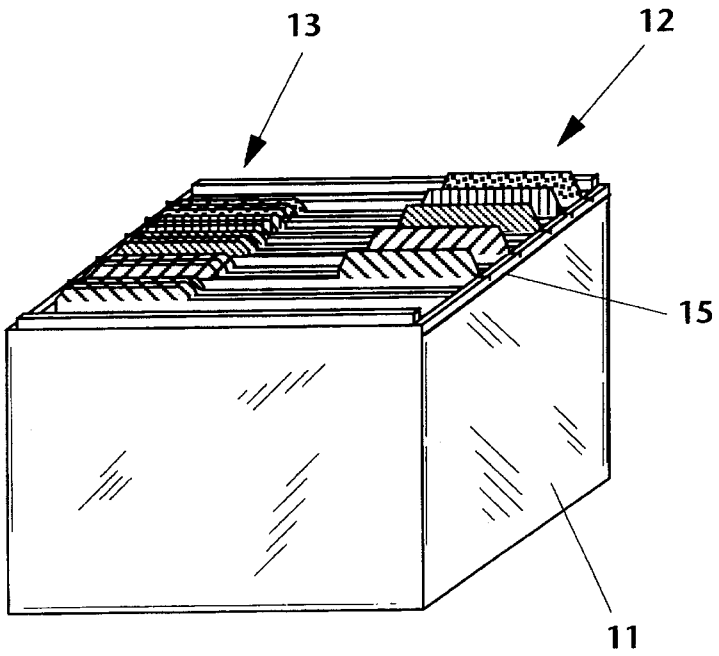
FIG. 1 is a perspective view of a file system arranged in accordance with the present invention.
FIG. 3 is a description of the icon-based file cross-reference system of the invention.

With regard to FIG. 1, the apparatus of the invention generally includes a file container 11, such as a file cabinet or file box, in which a series of hanging file folders 12 are supported. The container 11 includes opposed sides having upper edges provided with plastic or metal tracks 15 secured thereto to permit ease of movement of the hanging file folders. Each hanging file folder 12 is provided with an identifying color and a label setting forth a general topic or process procedure for the contents of the hanging file folder. More than one hanging file folder 12 may be provided with the same color as long as the same color folders contain related subject matter. Colors may be imparted by labels affixed to the tabs extending upwardly from each hanging file folder, or, more preferably, each hanging folder may be formed entirely from stiff material, such as card stock or the like, dyed or printed with the desired colors.

Within each file folder are a plurality of file folders 13, each also labeled and provided with the same color as the hanging file folder 12 in which it is placed. The file folders 13 are also labeled with subheadings for topics that are specific subjects relating to the general topic of the respective larger file folder 12. Within some of the file folders, the system provides forms to be filled in by the individual using the system. These forms elicit and organize information that pertains to the sub-heading of the respective file folder, and the forms provide a means to assure that this information has been gathered, organized, and placed in the appropriate file folder. In the preferred embodiment the larger file folders 12 may comprise suspended folders supported on the side edges of the file container 11, and the file folders may comprise single pocket folders or simple bifold file folders.

The invention also includes a cross-reference system for correlating information dispersed among the various file folders 13. With regard to FIG. 3, each file folder 13 may provided with one or more icons in addition to topic indicia. Each icon represents either a location of information relating to a particular topic or information processing task, or a cross-reference to another file folder. In the preferred embodiment, the hand icon indicates that further information is contained in another file folder. The pencil icon indicates that information in the folder may be required for paying taxes or filing tax returns. The star icon indicates that the file folder contains copies of documents which are stored elsewhere, such as a safe, fireproof box, or safe deposit box. The box icon is used to indicate that the file folder contains one or more questionnaire forms or information forms that may relate to legal or financial matters, lists of documents or facts, directives and/or instructions, or sub-categorizing of information.

Figure 2:
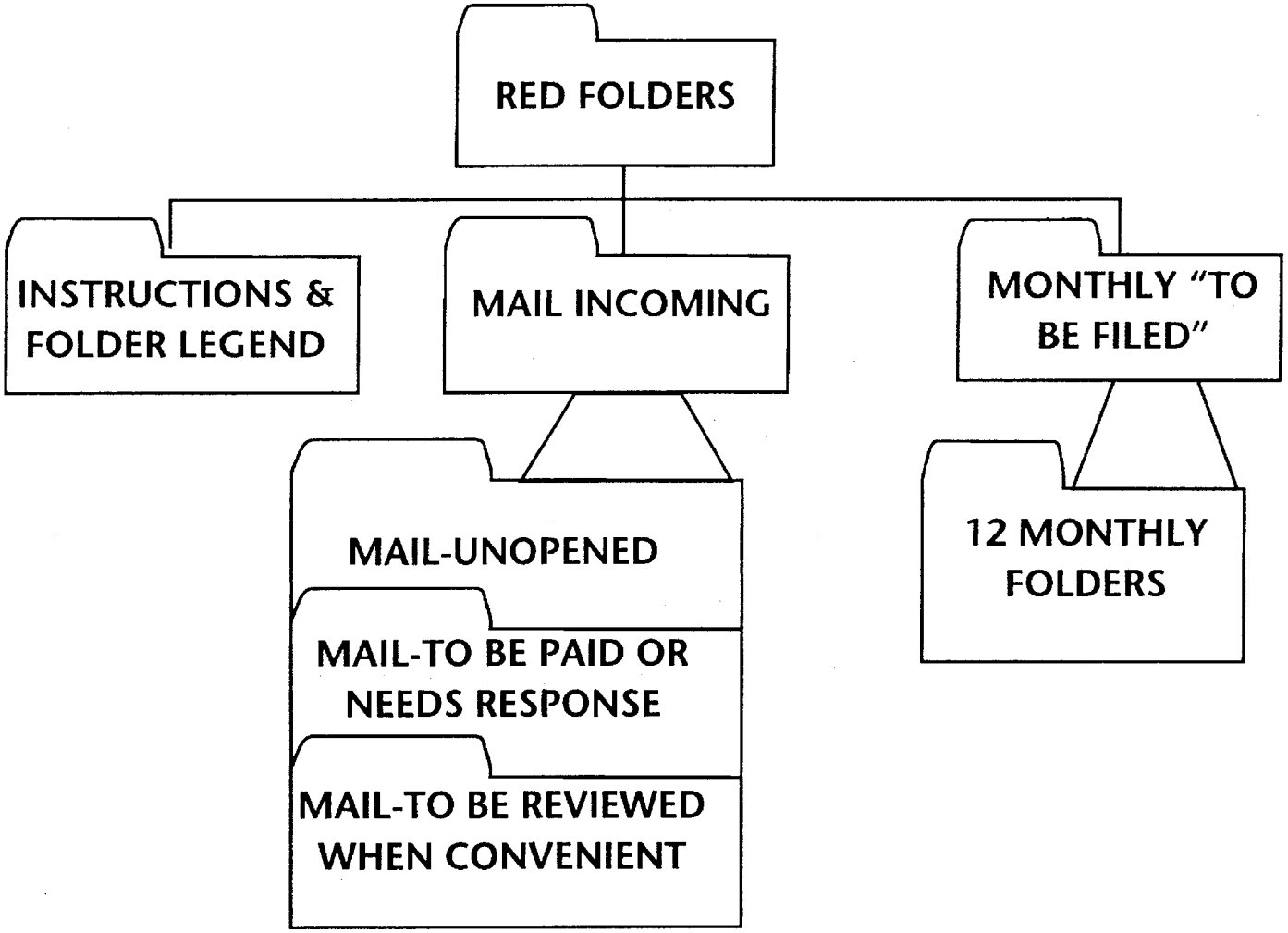
FIG. 2 is a functional block diagram of some of the red file folders relating to incoming information and documents to be processed quickly and efficiently.

With regard to FIG. 2, in the preferred embodiment a first plurality of file folders is dedicated to the organization, handling, and distribution of incoming information mail, bills to be paid, and paperwork to be filed. This first plurality is given a first color, preferably red, the color traditionally used to alert individuals, and comprises three file folders labeled INSTRUCTIONS & FOLDER LEGEND, MAIL INCOMING, and MONTHLY "TO BE FILED". The red file folders within the MAIL INCOMING hanging file folder comprise MAIL-OPENED, MAIL-TO BE PAID OR NEEDS RESPONSE, and MAIL-TO BE REVIEWED WHEN CONVENIENT. The red file folders within the MONTHLY "TO BE FILED" hanging file folder includes 12 folders, each labeled for one month of the year.

Figure 4:
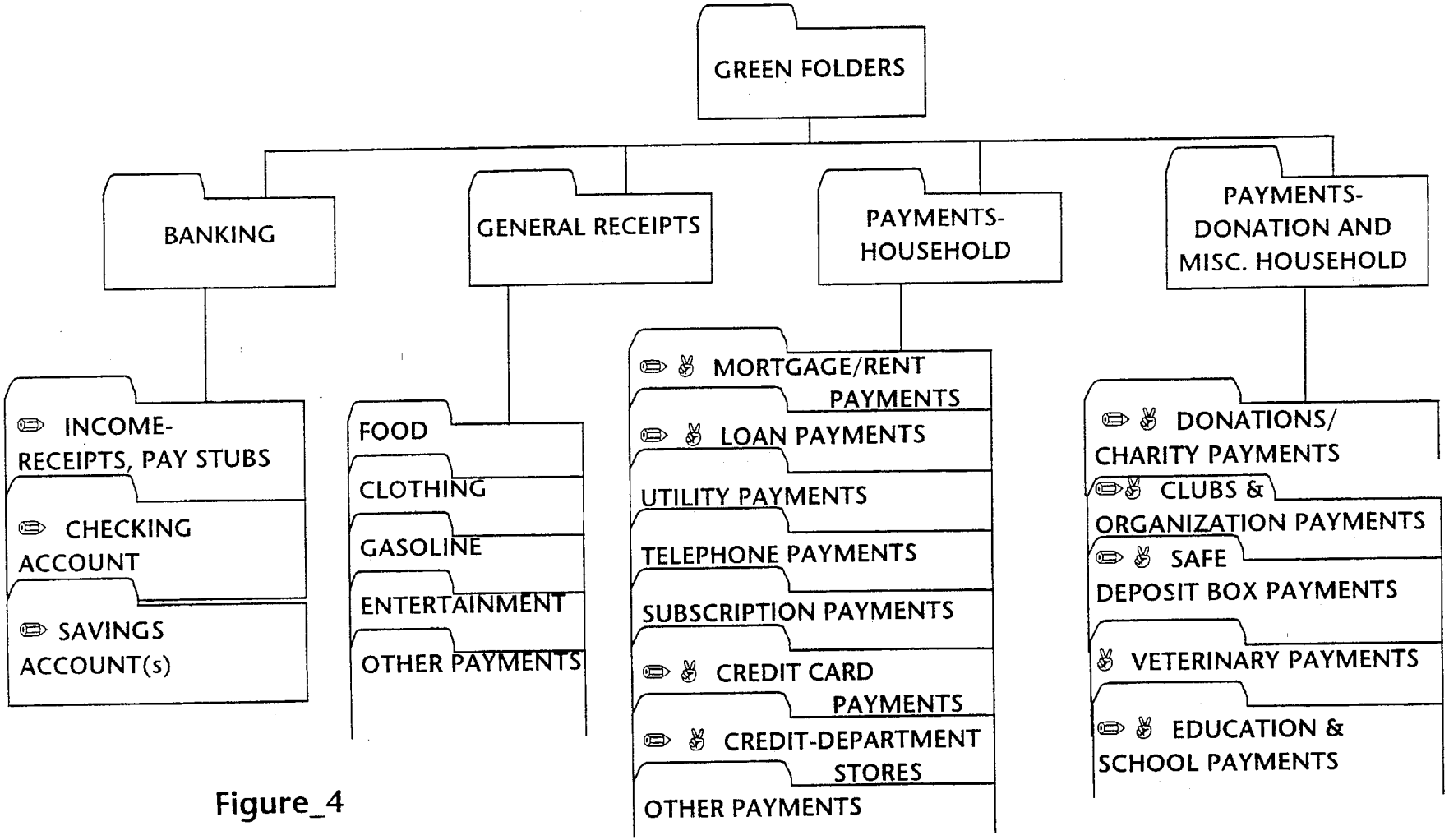
FIG. 4 is a description of some of the green file folders generally relating to yearly household bills and payments.
Figure 5:
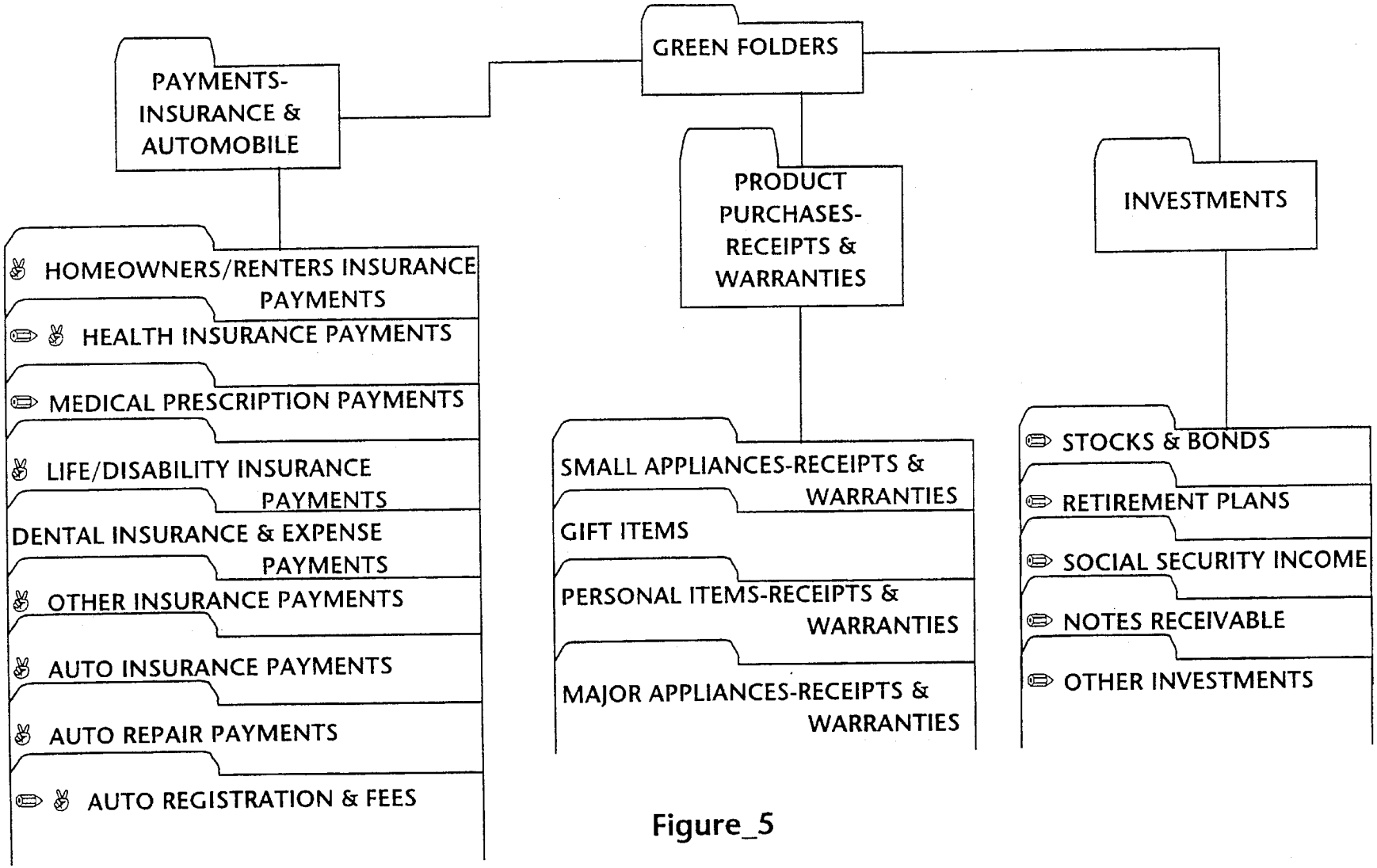
FIG. 5 is a description of further green file folders generally relating to yearly household bills and payments.

A second plurality of hanging file-folders, shown in FIGS. 4 and 5, is intended to be used for information and documentation relating to money taken in by the household and expenses paid out. This second plurality of hanging file folders is provided with a second color, preferably green, the traditional color to indicate money and financial affairs. The green hanging file folders are labeled BANKING, GENERAL RECEIPTS, PAYMENTS-HOUSEHOLD, PAYMENTS-DONATION AND MISC. HOUSEHOLD, PAYMENTS-INSURANCE & AUTOMOBILE, PRODUCT PURCHASES-RECEIPTS & WARRANTIES, and INVESTMENTS. A plurality of green file folders are provided for each green hanging file folder, and include subtopics that define filing spaces for each significant income source and household payment. These folders are designated to accumulate and store income and expense information throughout the year. At the end of the year, this information may be used to create an accounting of household expenses and income, to devise debt reduction and savings plans, and to generate a projected household budget based on the spending and income history of the previous year.

Figure 6:
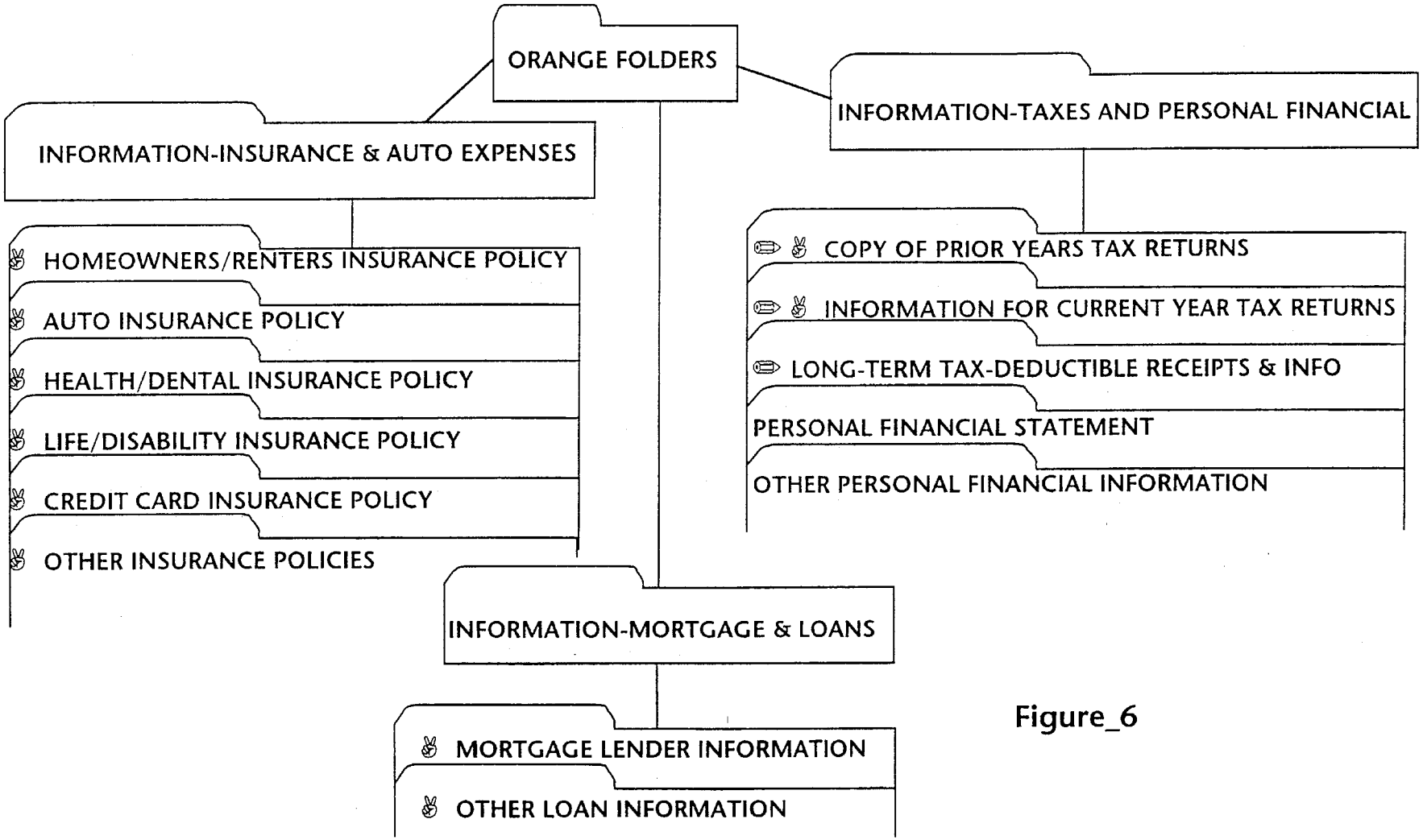
FIG. 6 is a description of orange file folders generally relating to long-term household financial information.

A third plurality of hanging file folders, shown in FIG. 6, is designated to store information for a period of years. This third plurality of hanging file folders is identified by a third color, which is orange in the preferred embodiment. One hanging folder contains all insurance policies, another contains prior tax returns, current year tax data, tax deductible receipts, and other personal financial information. A third orange file folder contains mortgage lender information and other loan information, all of these file folders being organized by file folders as shown in FIG. 6.

Figure 7:
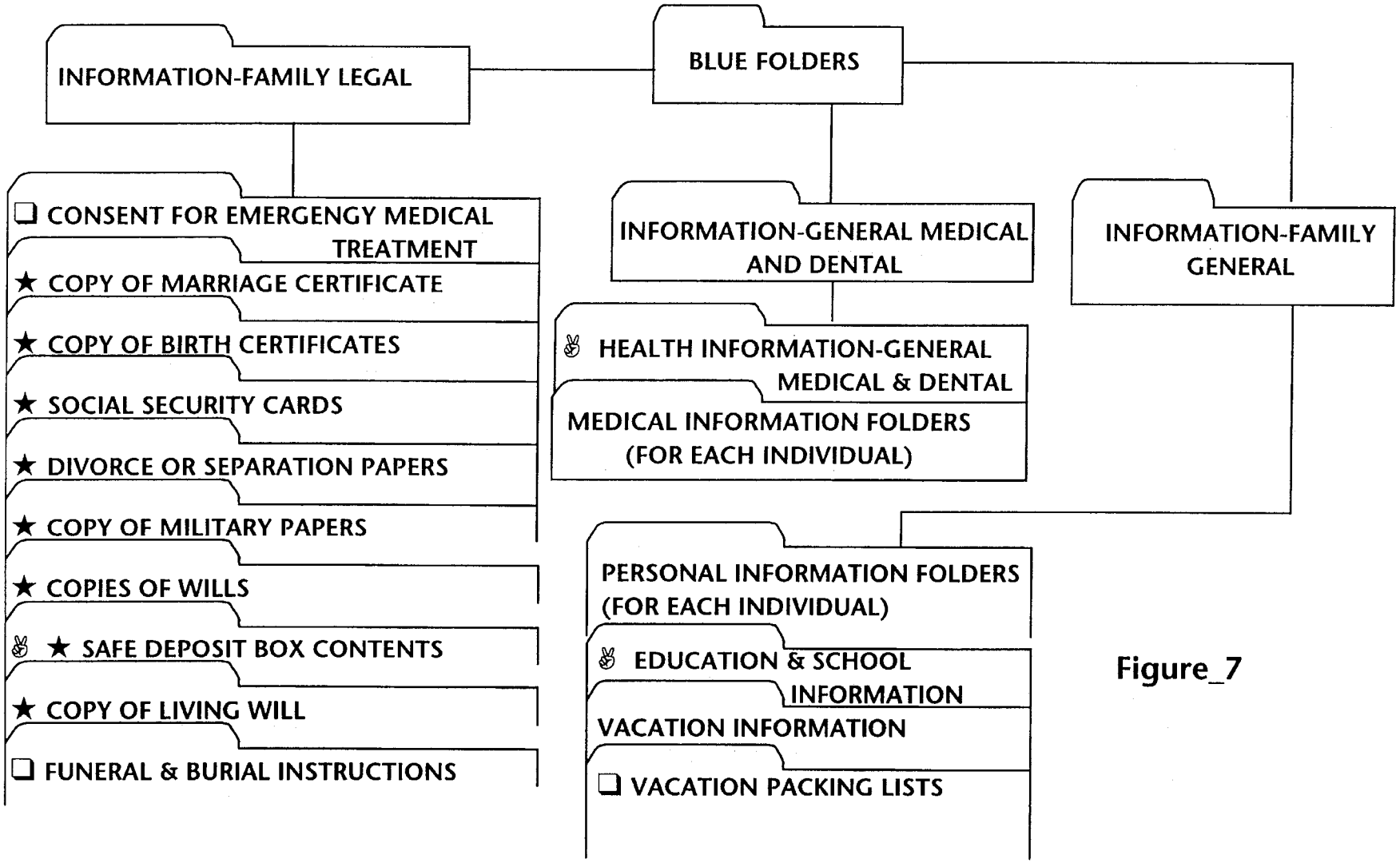
FIG. 7 is a description of blue file folders generally relating to long-term personal information.

With regard to FIG. 7 a fourth plurality of hanging file folders is devoted to long-term storage of personal and family information, and is provided with a fourth color, preferably blue. These hanging file folders are labeled INFORMATION-FAMILY LEGAL, INFORMATION-GENERAL MEDICAL AND DENTAL, and INFORMATION, FAMILY GENERAL. Within these hanging file folders, the related file folders (also of the fourth color) hold important documents such as marriage and birth certificates, copies of wills, medical information for each member of the household, and the like.

Figure 8:
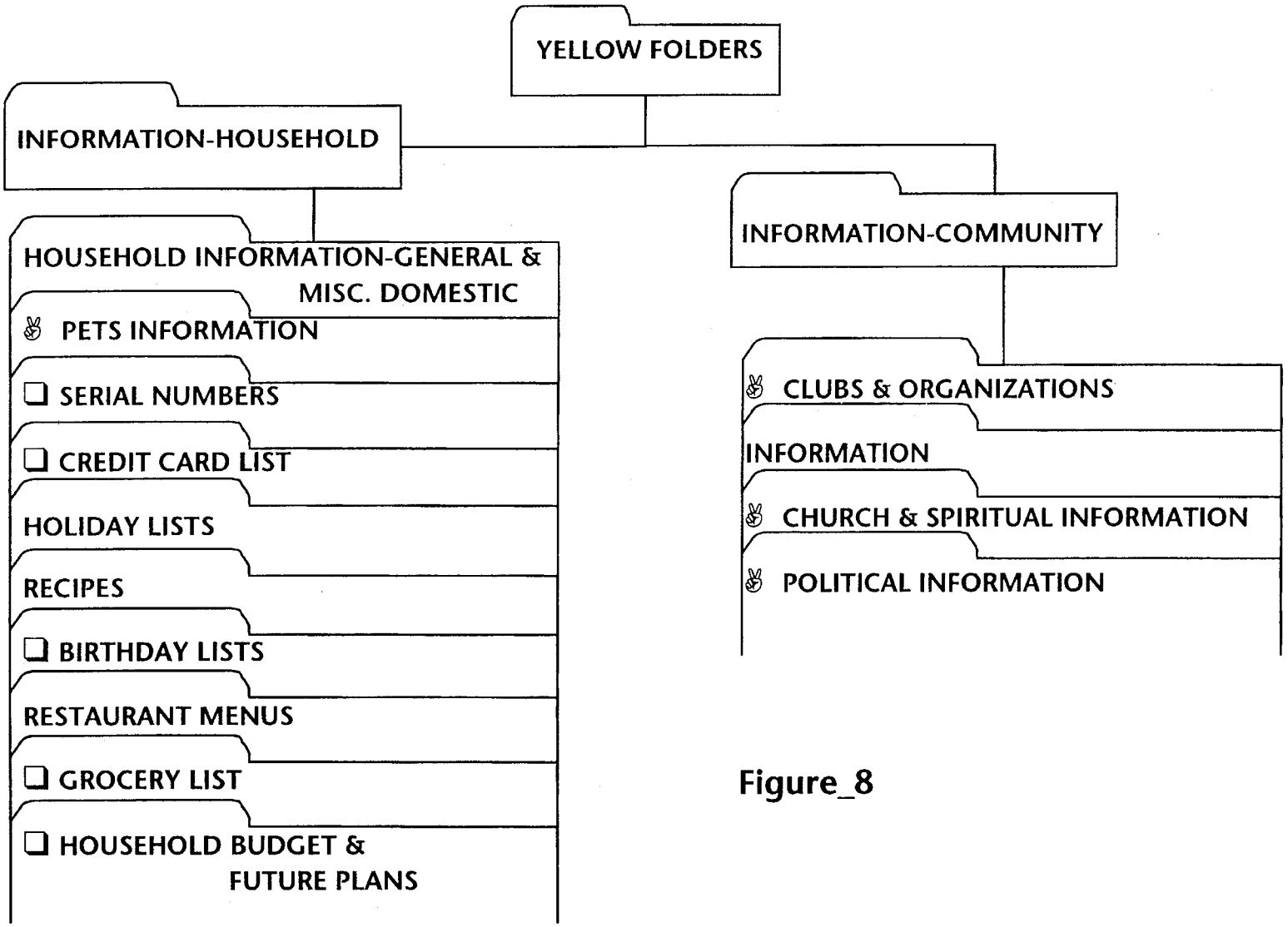
FIG. 8 is a description of yellow file folders generally relating to long-term household non-financial information.

Long-term storage of information relating to non-personal household items is the province of a fifth plurality of hanging file folders, shown in FIG. 8. These file folders are preferably yellow, and are titled INFORMATION-HOUSEHOLD and INFORMATION-COMMUNITY. The former hanging file folder contains file folders that store information on pets, serial numbers of appliances, lists of credit card numbers, birthdays, credit card numbers, grocery items, and the like. The latter hanging file folder contains file folders devoted to clubs and organizations, church matters, and political information.

The icons used to indicate cross-referenced information are also shown with the file labels, particularly in FIGS. 4-8 to indicate to the user that related information may be found in other hanging file folders 12 or other file folders 13.

Figure 9:
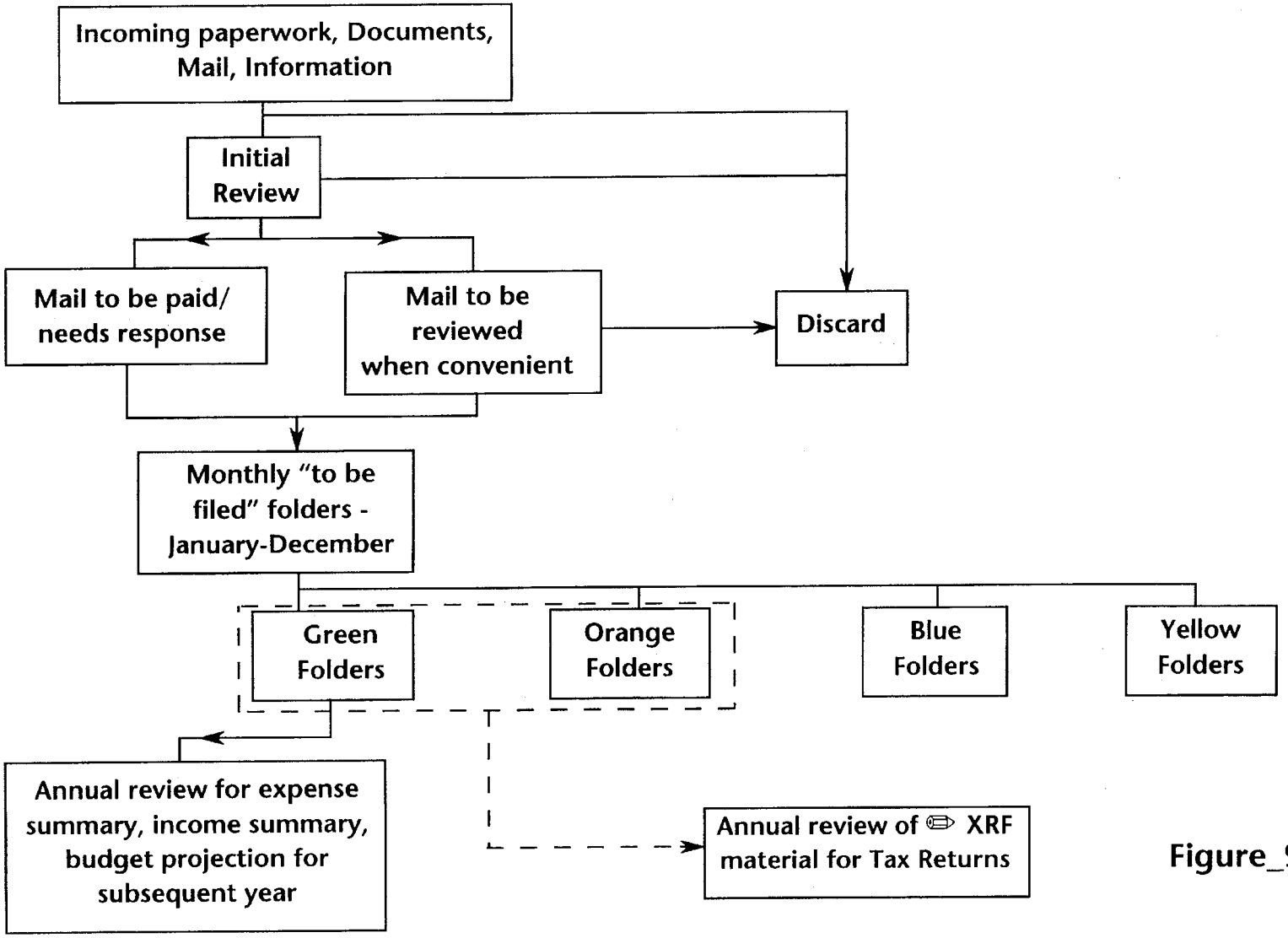
FIG. 9 is a functional block diagram depicting the steps used in processing documents and information in the filing system of the invention.

The file structure described above is designed to facilitate a method of household management that deals effectively with typical household matters such as receiving and paying out money, keeping track of expenses for budgetary purposes, storing important data that is used occasionally, and the like. With reference to FIG. 9, incoming paperwork, documents, mail, and information from the red folder "MAIL INCOMING" is first sifted to remove extraneous material, which is discarded, and the remainder is given an initial review. The items are then roughly sorted into the red file folders MAIL-TO BE PAID/NEEDS RESPONSE and MAIL-TO BE REVIEWED WHEN CONVENIENT. The items in the former file folder are surveyed frequently for bills to be paid, tasks to be accomplished, and the like, processed within the requisite time period and then filed in the appropriate MONTHLY "TO BE FILED" FOLDERS. Items in the latter file folder are reviewed and either discarded or processed and filed in the monthly folders. Items relating to income and expenses are placed in the appropriate green file folders.

After a year of using the filing system (or at the end of each tax year) the data in the green folders are collected to become the basis for an annual income summary, expense sugary, and budget projection for the subsequent year. Likewise, the data in the green and orange file folders marked with the pencil icon cross-reference are collected for tax returns, estimated tax payments, and the like. The process then begins anew by re-using the newly emptied red and green files. The information stored in the blue and yellow folders may be reviewed and updated periodically.

By following this system faithfully and devoting a few hour a month to processing paperwork and filing documents, a head of household may maintain control of household financial affairs, keep track of household and personal information, take care of tax obligations, and develop data that can be used to plan a realistic budget.

I claim:

1. A filing system for storing, organizing, and managing household and personal documents and information, including;

a first plurality of file folders disposed within a first plurality of divider file folders, said file folders and divider file folders having a common first color, said divider file folders labeled to receive incoming documents including mail, bills, and general information, said file folders labeled with subtopics to organize said incoming documents;

a second plurality of file folders disposed within a second plurality of divider file folders, said second file folders and second divider file folders having a common second color, said second divider file folders labeled to receive documents related to money received and money paid out, said second file folders labeled with subtopics to organize bank statements, income receipts, purchase receipts, and payments relating to household expenses;

a third plurality of file folders disposed within a third plurality of divider file folders, said third file folders and third divider file folders having a common third color, said third file folders labeled to receive documents related to household information regarding insurance, mortgage and other loans, tax returns, and other household financial matters;

a fourth plurality of file folders disposed within a fourth plurality of divider file folders, said fourth file folders and fourth divider file folders having a common fourth color, said fourth file folders labeled to receive documents related to household information regarding non-financial, personal matters;

whereby said incoming documents are initially sorted and placed in said first plurality of file folders in said first plurality of file folders for short-term storage, and said incoming documents are processed and filed in appropriately labeled file folders for long-term storage in said second, third, and fourth plurality of file folders.

2. The filing system of claim 1, further including cross-referencing means for said file folders to correlate information stored among said first, second, third, and fourth pluralities of file folders.

3. The filing system of claim 2, wherein said cross-referencing system includes a plurality of icon symbols selectively applied to said pluralities of file folders.

4. The filing system of claim 3, wherein said plurality of icon symbols includes a first icon to indicate that information stored in one file folder relates to further information stored in another file folder.

5. The filing system of claim 4, wherein said plurality of icon symbols includes a second icon to indicate that a file folder contains information pertaining to tax payment and tax returns.

6. The filing system of claim 5, wherein said plurality of icon symbols includes a third icon to indicate that a file folder contains copies of original documents that are being stored in another, safe location.

7. The filing system of claim 6, wherein said plurality of icon symbols includes a fourth icon to indicate that a file folder contains an information form to be completed by the user of the filing system.

8. The filing system of claim 1, wherein said first color comprises red.

9. The filing system of claim 8, wherein said second color comprises green.

10. The filing system of claim 9, wherein said third color comprises orange.

11. The filing system of claim 10, wherein said fourth color comprises blue.

12. The filing system of claim 1, further including a fifth plurality of file folders disposed within a fifth plurality of file folders, said fifth file folder and fifth file folders having a common fifth color, said fifth file folders labeled to receive documents related to household information regarding non-financial household and community matters.

13. The filing system of claim 12, wherein said fifth color comprises yellow.

14. The filing system of claim 1, further including means for eliciting and organizing predetermined information from the user of the filing system.

15. The filing system of claim 14, wherein said means for eliciting and organizing includes a plurality of information forms bearing questions to be completed by the user of the filing system.

16. The filing system of claim 15, wherein said plurality of information forms are disposed in preselected file folders having subhead titles appropriate to the data contained in the respective information forms.

17. The filing system of claim 16, further including icon means for labeling file folders having at least one of said information forms disposed therein.

18. A method for processing and filing information and documents relating to household operation to regularize the tasks associated with personal and household financial and personal matter, including the steps of:

providing a first plurality of file folders disposed within a first plurality of divider file folders, said file folders and divider file folders having a common first color, said divider file folders labeled to receive incoming documents including mail, bills, and general information, said file folders labeled with subtopics to organize said incoming documents;

providing a second plurality of file folders disposed within a second plurality of divider file folders, said second file folders and second divider file folders having a common second color, said second divider file folders labeled to receive documents related to money received and money paid out, said second file folders labeled with subtopics to organize bank statements, income receipts, purchase receipts, and payments relating to household expenses;

providing a third plurality of file folders disposed within a third plurality of divider file folders, said third file folders and third divider file -folders having a common third color, said third file folders labeled to receive documents related to household information regarding insurance, mortgage and other loans, tax returns, and other household financial matters;

providing a fourth plurality of file folders disposed within a fourth plurality of divider file folders, said fourth file folders and fourth divider file folders having a common fourth color, said fourth file folders labeled to receive documents related to household information regarding non-financial, personal matters;

processing incoming documents and information by initially sorting said documents and information and placing items requiring action without delay into appropriately labeled first file folders, and placing documents for long-term storage in appropriately labeled third and fourth file folders; and, retrieving documents and information from said first file folders and carrying out the action required by these items, thereafter placing these items into appropriately labeled second file folders.

19. The method of claim 18, further including the step of periodically removing all items from said second file folders to establish an income summary, expense summary, and projected budget.

20. The method of claim 18, further including the step of cross-referencing all of said pluralities of files by applying a plurality of icons to selected file folders.

21. The method of claim 20, wherein a first of said plurality of icons is designated to indicate that information stored in a file folder labeled with said first icon relates to further information stored in another file folder.

22. The method of claim 21, wherein a second of said plurality of icons is designated to indicate that a file folder contains information pertaining to tax payment and tax returns.

23. The method of claim 22, wherein a third of said plurality of icons is designated to indicate that a file folder contains copies of original documents that are being stored in another, safe location.

24. The method of claim 23, wherein a fourth of said plurality of icons is designated to indicate that a file folder contains an questionnaire form to be completed by the user of the filing system, whereby data pertaining to the file folder subtopic is elicited, organized, and filed for easy retrieval.

* * * * *